US006352063B1

(12) United States Patent
Weslake-Hill

(10) Patent No.: US 6,352,063 B1
(45) Date of Patent: Mar. 5, 2002

(54) ROTARY PISTON MACHINES

(75) Inventor: Ian Weslake-Hill, Cardiff (GB)

(73) Assignee: Ceres IPR Limited, Cheshire (GB)

( * ) Notice: Subject to any disclaimer, the term of this patent is extended or adjusted under 35 U.S.C. 154(b) by 0 days.

(21) Appl. No.: 09/673,975

(22) PCT Filed: Apr. 26, 1999

(86) PCT No.: PCT/GB99/01290

§ 371 Date: Nov. 30, 2000

§ 102(e) Date: Nov. 30, 2000

(87) PCT Pub. No.: WO99/56013

PCT Pub. Date: Nov. 4, 1999

(30) Foreign Application Priority Data

Apr. 25, 1998 (GB) ..... 9808780

(51) Int. Cl.[7] ..... F02B 53/04
(52) U.S. Cl. ..... 123/234; 123/237
(58) Field of Search ..... 123/241, 242, 123/249, 204, 228, 234, 237; 60/682; 418/61.2, 159

(56) References Cited

U.S. PATENT DOCUMENTS 3,744,940 A 7/1973 Pierce et al.
3,763,649 A 10/1973 Wahnschaffe et al.
4,463,718 A * 8/1984 Griffith ..... 123/242
4,562,804 A * 1/1986 Tadokoro et al. ..... 123/242 X
4,614,173 A * 9/1986 Okimoto et al. ..... 123/242 X
5,251,596 A 10/1993 Westland
5,310,325 A * 5/1994 Gulyash ..... 123/242 X
5,410,998 A 5/1995 Paul et al.

* cited by examiner

*Primary Examiner*—Hoang Nguyen
(74) *Attorney, Agent, or Firm*—Young & Thompson

(57) ABSTRACT

A rotary piston machine adapts the Stirling principle and can operate as an engine or a heat pump. Two variable volume units (1,4) have n-lobed chambers (3,6) rotatable about a common axis at a first speed. Each chamber contains an (n+1) sided piston (2,5), these being rotatable about a different common axis at a different second speed, and co-operating with the lobes to form expanding and reducing sub-chambers. The first to second speed ratio is (n+1):n.n ducts (10,11) incorporating regenerators provide intercommunication between the chambers (3,6) and are open and closed by the relative piston rotation to exchange fluid or vapour between units. Heating may be provided for one unit, the expansion unit (1), and cooling for the other, the compression unit (4), and the ducts can also incorporate heating and cooling means.

14 Claims, 4 Drawing Sheets

ROTARY PISTON MACHINES

This invention relates to rotary piston machines. It is concerned with an adaptation of the Stirling principle, with multi-sided rotary pistons operating in chambers with epitrochoidal lobes, the working fluid or vapour undergoing closed thermodynamic cyclic processes. The machine may operate as an engine or as a heat pump.

According to the present invention there is provided a fluid or vapour rotary piston machine including two variable-volume units, each unit having a rotary multi-lobed epitrochoidal chamber and a multi-sided rotary piston therein forming a plurality of invididual sub-chambers by its co-operation with the periphery of the associated chamber, the number (n+1) of piston sides being greater by one than the number (n) of epitroichoid arcs, wherein the two chambers are constrained to rotate at a first common speed about a first effective common axis while the two pistons are constrained to rotate at a second common speed about a second effective common axis, the ratio of first to second common speeds being n+1:n, wherein each chamber has a plurality (n) of dual-function ports enabling connection between the chambers via ducts, and wherein said ducts each contain a regenerator, enabling one variable-volume unit to perform intake, expansion and exhaust, while the other unit performs intake, compression and exhaust, as a result of the relative rotation and port positions.

Preferably, the chambers will be co-axial, as will be the rotors. That simplifies construction. But they could, in theory, be on different axes but coupled to rotate in liaison. The term "effective" is intended to cover this alternative.

Figure 7:
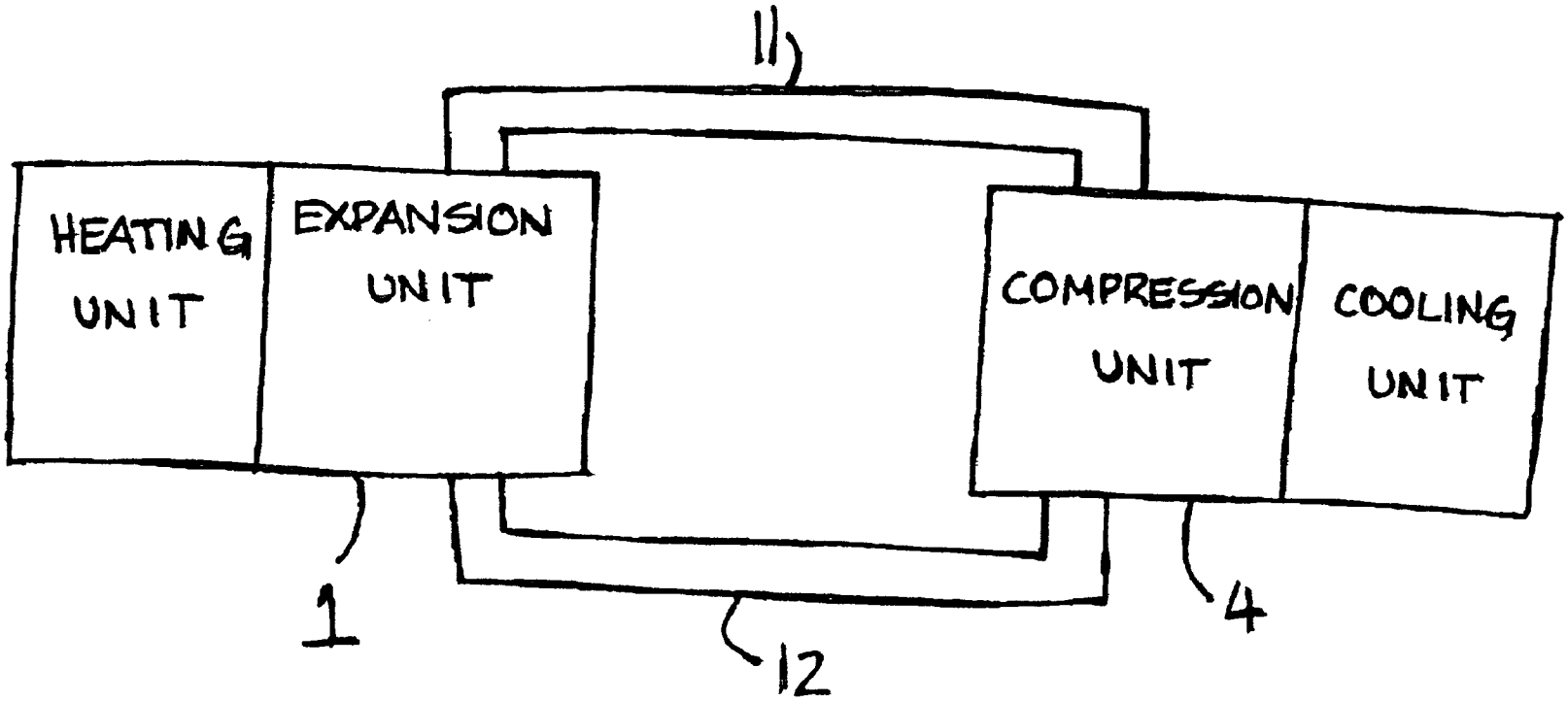

Heating means may be provided for the variable-volume unit which performs the expansion processes, as shown schematically in FIG. 7, and there could be further heating means between each said regenerator and the variable-volume unit which performs the expansion processes.

Cooling means may also be provided for the variable-volume unit which performs the compression processes, as shown schematically in FIG. 7, and there could be further cooling means between each said regenerator and the variable-volume unit which performs the compression processes.

In the preferred form n=2, so that there are three sided pistons operating in double-lobed chambers.

The expansion unit which may, but not necessarily, be heated, will have its ports disposed in such a way that the chambers formed therein are increasing in volume generally when not in communication with a port and decreasing in volume generally when said chambers are in communication with a port. The other, compression unit which may, but not necessarily, be cooled, will have its ports disposed in such a way that the chambers formed therein are decreasing in volume generally when not in communication with a port, and increasing in volume generally when said chambers are in communication with a port. Work processes thus occur in chambers isolated from port openings, while the transfer of working fluid or vapour occurs between a pair of chambers each in communication with ports opening to a common duct. If high-grade heat transfer is accomplished to the working fluid or vapour flowing to, from or contained within, the expansion unit, while low-grade heat transfer is accomplished from the working fluid or vapour flowing to, from, or contained within, the compression unit, the machine behaves as an engine, with mechanical work output. If mechanical work is applied to the rotating components, but low-grade heat transfer is accomplished to the region of the expansion unit while high-grade heat transfer occurs from the region of the compression unit, the machine behaves as a heat pump or refrigerating machine.

Figure 4:
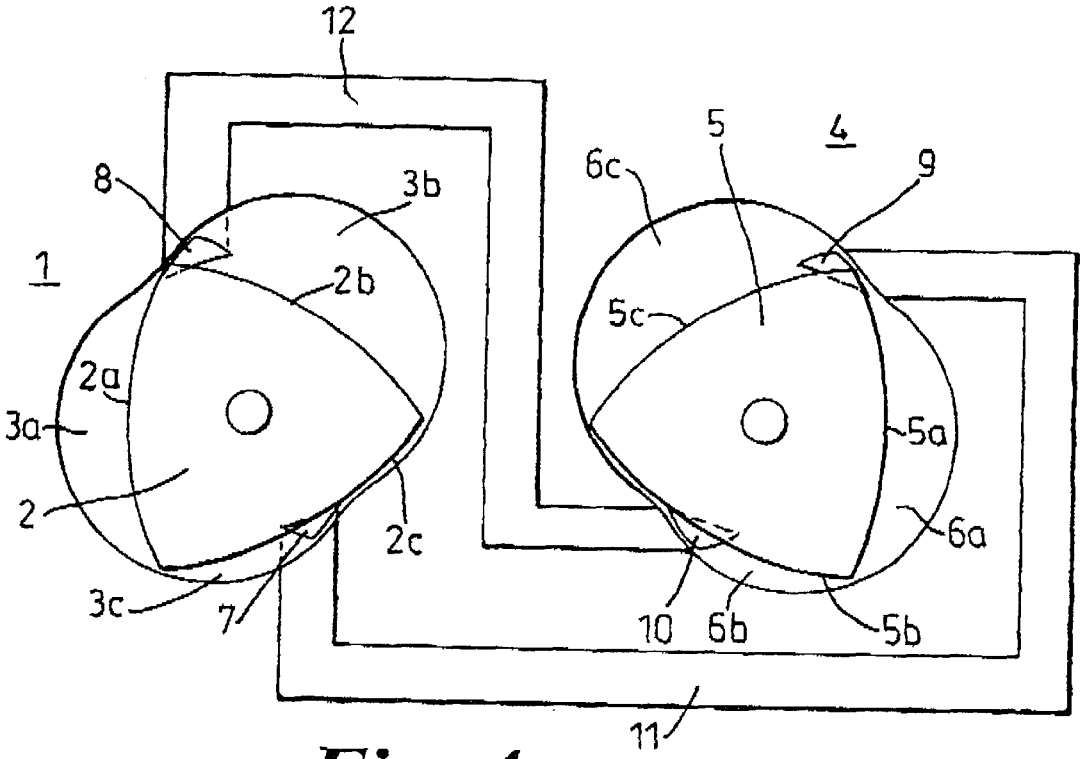
Figure 5:
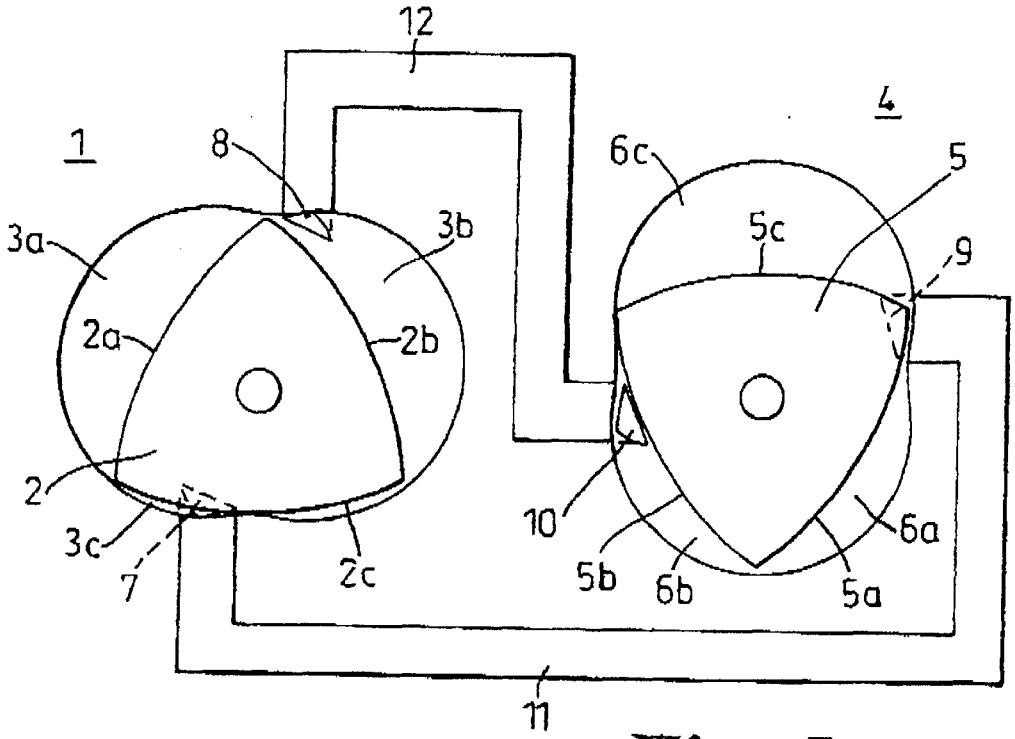
Figure 6:
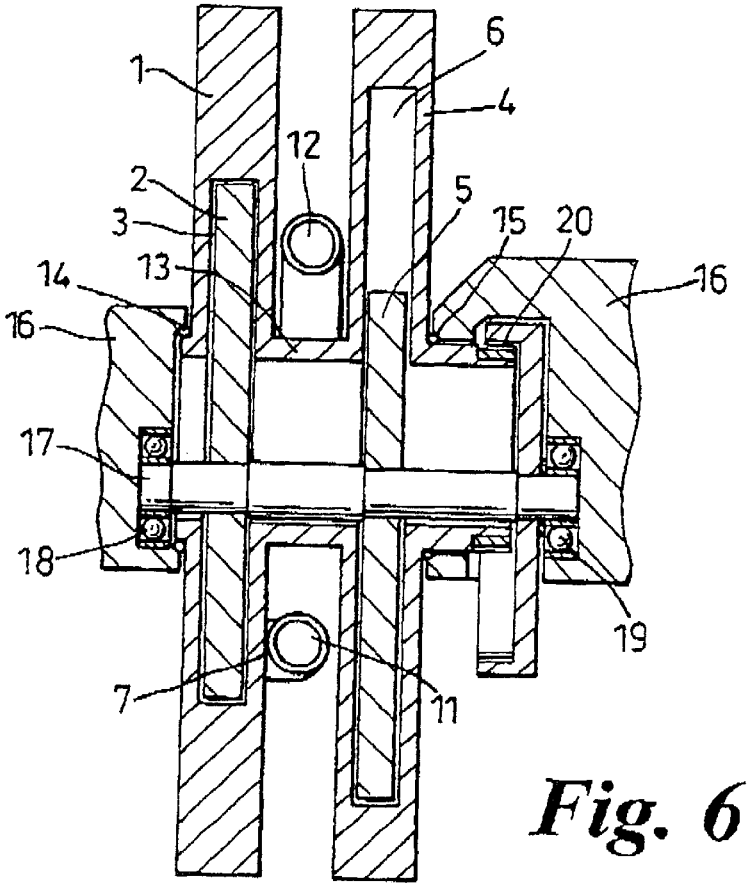

For a better understanding of the invention, reference will now be made by way of example, to the accompanying drawings, in which:

FIGS. 1, 2, 3, 4 and 5 are schematic diagrams showing the relative positions of expansion and compression unite of a rotary piston machine at intervals during a cycle of rotation, FIG. 6 is a diagrammatic cross-section through a preferred embodiment of the machine, and FIG. 7 is a schematic illustration showing the heating and cooling units.

An expansion unit 1 has a rotary piston 2 contained in a chamber 3 and a compression unit 4 has a rotary piston 5 contained in a chamber 6. Each piston 2 and 5 is of flat, generally equilateral triangular form, but with the sides of the triangle convex and arcuate. Each chamber 3 and 6 is also flat, closely to confine the faces of the piston, and is of two-lobed epitrochoidal form. The chambers thus have major and minor axes intersecting at right angles at their centres. The two units 1 and 4 are rigidly linked to rotate about a common axis through their centres in the same direction and at the same speed, the major axes of the chambers 3 and 6 being at 90° to each other. The two rotary pistons 2 and 5 are also rigidly linked to rotate about a common axis through their centres in the same direction and at the same speed, this being two thirds the speed of rotation of the chambers 3 and 6. The arcuate sides 2*a*, 2*b* and 2*c* of the piston 2 are disposed at 180° to the counterpart sides 5*a*, 5*b* and 5*c* of the other piston 5. The sides of the pistons 2 and 5 co-operate with the profiles of the respective chambers 3 and 6 to form sub-chambers 3*a*, 3*b* and 3*c* and 6*a*, 6*b* and 6*c*, of variable volume and shape in operation, as described below.

Ports 7 and 8 in the expansion unit 1 are diagonally opposite each other and offset 30° in the direction of motion (clockwise as seen in FIGS. 1 to 5) from the minor axis of the chamber 3. Corresponding ports 9 and 10 are similarly disposed in the compression unit 4, but are offset by 30° in the direction opposite that of rotation from the minor axis of the chamber 6. This positioning ensures that during operation a port, 7 or 8, is about to open to a sub-chamber when that sub-chamber is at maximum volume in the expansion unit 1. Similarly, a port, 9 or 10, has just closed to a sub-chamber when that sub-chamber is at maximum volume in the compression unit 4. The expansion unit port 7 is linked by an interconnecting duct 11 to the compression port 9 diagonally opposite with reference to the axis of rotation of the units 1 and 4, while the expansion unit port 8 is similarly linked-by an interconnecting duct 12 to the compression unit port 10. These ducts each contain a regenerator (not shown).

Figure 1:
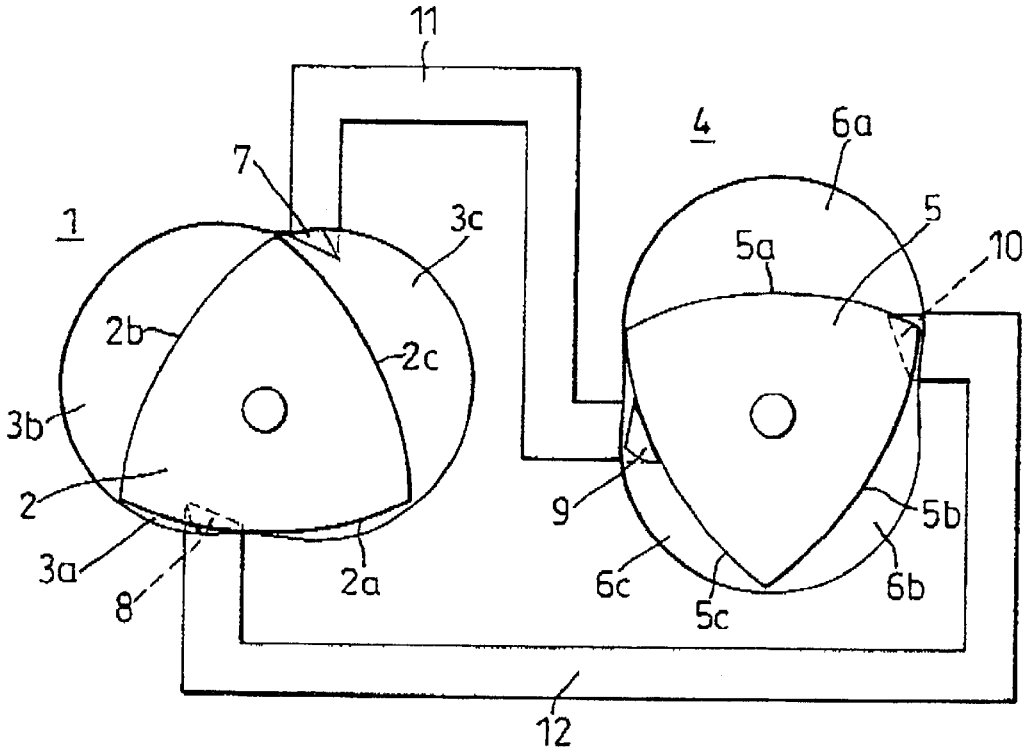

The sequence of operation is as follows:

In FIG. 1, heated working fluid or vapour occupies the sub-chamber 3*a*, which is at minimum volume and is open, via the port 8, to the duct 12. The sub-chamber 3*b* is isolated and increasing in volume. The sub-chamber 3*c* is decreasing in volume, thereby expelling working fluid or vapour via the port 7, through the duct 11. The fluid or vapour is giving up, in the case of an engine, or taking up, in the case of a heat pump, heat within the regenerator in that duct 11. Cooled working fluid or vapour occupies the chamber 6*a* which is at maximum volume, isolated, and about to start its compression cycle. The sub-chamber 6*b* is in its compression cycle, is decreasing in volume and isolated. The sub-chamber 6*c* is increasing in volume and is open, via the port 9, to the duct 11. It is therefore receiving the working fluid or vapour from the sub-chamber 3*c*. The port 10 is closed by the piston 5.

Figure 2:
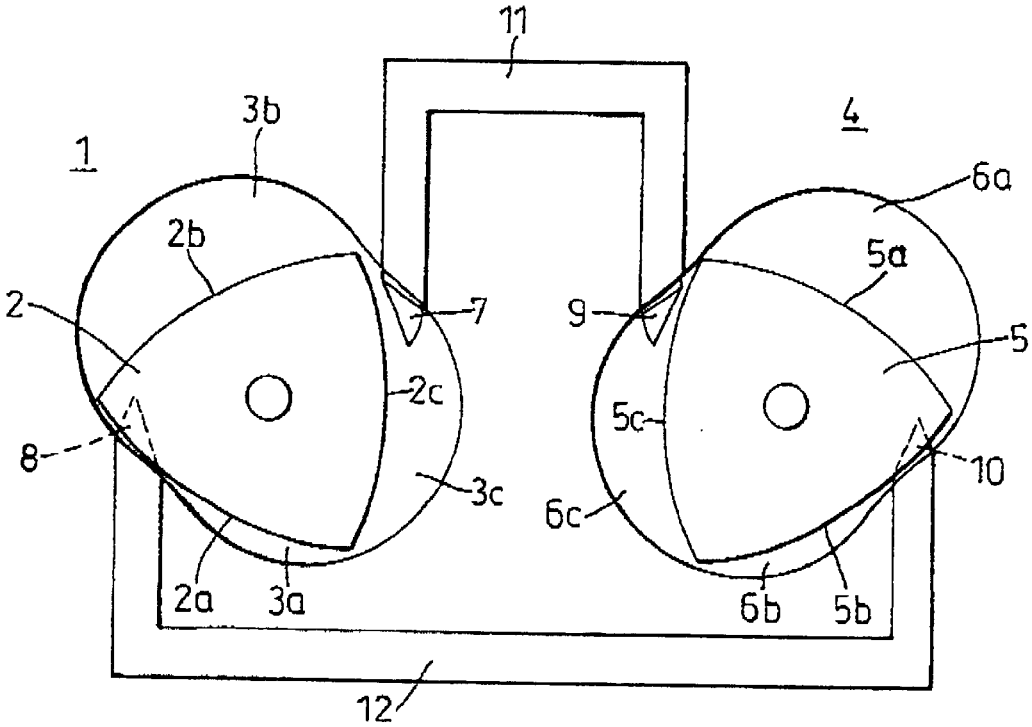

In FIG. 2 the pistons 2 and 5 have rotated clockwise by 30° and the chambers 3 and 6 by 45°. The sub-chamber 3*a* is increasing in volume and accepting working fluid or vapour, via the port 8, from the duct 12 and from the sub-chamber 6*b*, which continues to decrease in volume and now communicates with the port 10. The sub-chamber 3*b* continues to increase in volume, with the isolated heated working fluid or vapour therein being expanded, while the transfer of working fluid or vapour continues from the sub-chamber 3*c* to the sub-chamber 6*c* via the port 7, the duct 11, and the port 9. The cooled working fluid or vapour in the sub-chamber 6*a* remains isolated and is compressed as the volume of that sub-chamber decreases.

Figure 3:
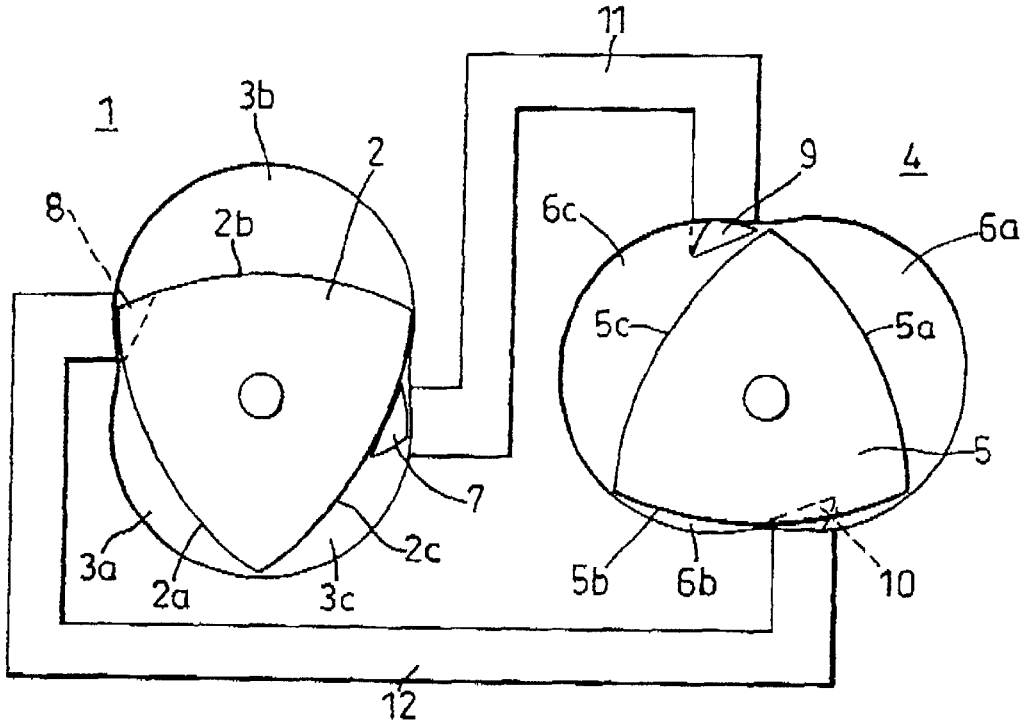

In FIG. 3 the pistons have rotated through 60° from their initial positions and the chambers by 90°. The sub-chamber 3*a* continues to increase in volume, but the piston 2 closes the port 8, thereby terminating the ingress of working fluid or vapour, whereupon the expansion process commences within that sub-chamber. The sub-chamber 3*b* has attained its maximum volume, and the heated working fluid therein has reached the end of its expansion process, while the sub-chamber 3*c* continues to decrease in volume with the egress of working fluid or vapour, via the port 7, the duct 11 and the port 9 to the compression unit 4. The cooled working fluid continues to be compressed in the isolated sub-chamber 6*a* as the volume therein decreases. The sub-chamber 6*b* is at minimum volume and open, via the port 10, to the duct 12, but the working fluid or vapour ceases to flow due to the closure of the port 8. The sub-chamber 6*c* continues to increase in volume and to accept the working fluid or vapour, via the port 9, from the sub-chamber 3*c*.

In FIG. 4 the pistons 2 and 5 have moved on another 30° and the chambers 3 and 6 another 45°. The sub-chamber 3*a* is isolated and increasing in volume, with the heated working fluid therein continuing its expansion process. The sub-chamber 3*b* now communicates with the port 8 as that is uncovered by the piston 2 and, since that sub-chamber is decreasing in volume, the working fluid or vapour therein is forced out into the duct 12. The sub-chamber 3*c* continues to decrease in volume, and transfer of working fluid or vapour, via the port 7, the duct 11 and the port 9, continues to the compression unit 4. The sub-chamber 6*a* remains isolated and decreasing in volume, with the cooled working fluid or vapour therein continuing its compression process. The sub-chamber 6*b* is now increasing in volume and, due to its communication with the port 10, accepts the working fluid or vapour from the sub-chamber 3*b* via the duct 12. The sub-chamber 6*c* continues to increase in volume and the ingress of working fluid or vapour continues, via the port 9 and the duct 11, from the expansion unit 1.

In FIG. 5 the pistons are 120° from their original positions and the chambers 180° from theirs. The sub-chamber 3*a* continues to increase in volume, with the heated, isolated working fluid therein continuing its expansion process. The sub-chamber 3*b* continues to decrease in volume, with its working fluid or vapour passing via the port 8, the duct 12, and the port 10 to the sub-chamber 6*b* which is increasing in volume, The sub-chamber 3*c* is at minimum volume and open, via port 7, to the duct 11, but the compression unit piston 5 has closed the port 9, and so the working fluid or vapour ceases to flow. The sub-chamber 6*a* is still isolated and decreasing in volume, with the cooled working fluid therein at the end of its compression process. The sub-chamber 6*b* continues to accept the transferred working fluid or vapour from the expansion unit 1, The sub-chamber 6*c*, now isolated due to the closure of the port 9, is at maximum volume with the working fluid or vapour therein at the commencement of its compression process. The situation within the machine is now similar to that of FIG. 1, although the various bodies of working fluid or vapour occupy different spaces to those in the earlier diagram.

Consider the body of cooled working fluid in the sub-chamber 6*a* in FIG. 1 at the commencement of its compression process. As the units 1 and 4 rotate through 180° and the rotary pistons 2 and 5 rotate through 120°, the relative rotor rotation will be 60° in the opposite direction. This finds the body of fluid in sub-chamber 6*a* at the end of its compression process in a similar situation to that of the cooled working fluid or vapour in the sub-chamber 6*b* in FIG. 1. After a further 30° of relative rotor rotation (corresponding to the FIG. 3 positions) the sub-chamber 6*a* will be at minimum volume, and the major proportion of the working fluid or vapour that was therein will have transferred to the sub-chamber 3*c* via the port 9, the ducts 11 and the port 7, absorbing, in the case of an engine, or rejecting, in the case of a heat pump, heat during its passage through duct 11. At this point, where the total relative rotor rotation is 90°, the piston 2 will have passed the port 7. The expander sub-chamber 3*c* allows expansion of the heated working fluid or vapour therein until a further 60° of relative rotor rotation has occurred (making the total 150° ), when the sub-chamber 3*c* is at maximum volume. Further rotation uncovers the port 8, allowing egress of heated working fluid or vapour via the duct 12, in which it is cooled in the case of an engine, or heated in the case of a heat pump. It then enters the sub-chamber 6*c* via the port 10, this transfer process occurring over a further 90° of relative rotor rotation, the total then being 240°, when the sub-chamber 3*c* will be at minimum volume. The piston 5 now covers port 10 and the thermodynamic cycle involving this particular body of working fluid or vapour is repeated.

The processes may be tabulated over 360° of relative rotor rotation, corresponding to 720° of piston rotation and 1080° of chamber rotation, as set out below in Table 1.

The closed thermodynamic cycle described above occurs and repeats, with phase displacement, with four main bodies of working fluid or vapour. In FIG. 1, these are located in sub-chamber 6*a* at the commencement of compression, in sub-chamber 6*b* towards the end of compression, in sub-chambers 3*c* and 6*c* and duct 11 undergoing regenerative transfer, and in sub-chamber 3*b* undergoing expansion. The residual working fluid or vapour in sub-chamber 3*a* is awaiting mixing with the main body of working fluid or vapour in the sub-chamber 6*b*. It will be noted that work processes in both the expansion and compression units are of equal duration, namely 60° of relative rotor rotation. Working fluid or vapour regenerative transfer from the compression unit 4 to the expansion unit 1 is always to a sub-chamber of dissimilar designation, that is, 6*a* to 3*c*, 6*b* to 3*a* and 6*c* to 3*b*, and is of short duration, namely 30° of relative rotor rotation. Working fluid or vapour regeneration transfer from the expansion unit 1 to the compression unit 4 is always to a sub-chamber of similar designation, that is, 3*a* to 6*a*, 3*b* to 6*b* and 3*c* to 6*c*, and is of long duration, namely 90° of relative rotor rotation. If the units 1 and 4 are of equal size, which is not a necessity, the geometry ensures that this latter transfer occurs under constant summed volume, The regenerative transfer of any one main body of working fluid or vapour is always accomplished alternately between the two ducts 111 and 12. That is, transfer from one unit to the other via one duct is always followed by the return transfer via the other duct. Because of the pairings of sub-chambers during those transfers, any one main body of working fluid or vapour will eventually be transported through every sub-chamber within the machine, allowing mass and energy balances of the working fluid or vapour to be attained rapidly.

The route followed by one main body of working fluid or vapour may be tabulated over 720° of relative rotor rotation, corresponding to 1440° of piston rotation and 2160° of housing rotation, as shown below in Table 2. The main body of working fluid or vapour under study in that table is that which appears in sub-chamber 6*a* in FIG. 1, at the start of its compression process. It can be seen to undergo three complete thermodynamic cycles before it returns to that sub-chamber 6*a*, after passing through all the other sub-chambers of the machine. A second main body of working fluid or vapour which appears in sub-chamber 6*b* in FIG. 1, undergoing its expansion process, will follow an identical route to that shown in Table 2, with a phase displacement of +360° relative rotor rotation from that shown in Table 2. A third main body of working fluid or vapour which appears in sub-chamber 6*b* in FIG. 1, towards the end of its compression process, will follow a similar route, but with the ducts interchanged so that expansion unit to the compression unit transfers are made via the duct 11 whilst the reverse transfers are made via the duct 12, with a phase displacement of +180° relative rotor rotation from that shown in Table 2. The fourth main body of working fluid or vapour which appears in sub-chambers 3*c* and 6*c* and duct 11 in FIG. 1, undergoing regenerative transfer to the compression unit, will follow an identical route to that of the third main body of fluid or vapour, with a phase displacement of −180° relative rotor rotation from that shown in Table 2. The machine therefore provides for a total of twelve thermodynamic cycles over the period defined by 1440° of piston rotation, corresponding to 2160° of chamber rotation and 720° of relative rotor rotation.

It should be noted that each individual thermodynamic cycle occurs over a period defined by 240° of relative rotor rotation, that is, 480° of piston rotation and 720° of chamber rotation. Whichever component, whether the coupled pistons 2 and 5 or the coupled units 1 and 4 is employed as the engine work output medium or heat pump work input medium, the thermodynamic cycles have a longer duration than those occurring in conventional reciprocating heat engines and reciprocating heat pumps. These must, perforce, occur over 360° of the output, or input, shaft rotation. This feature of the rotary machine described above allows enhanced heat transfer processes, enabling the theoretically ideal thermodynamic cycle to be approached.

In FIG. 6, the two units 1 and 4 are rigidly coupled by a hollow shaft 13 journalled at 14 and 15 in a fixed mounting 16. The pistons 2 and 5 are carried by a common shaft 17 journalled at 18 and 19 in the mounting 16. The ports 7, 8, 9 and 10 are in the flat radial sides of the chambers 3 and 6, near their peripheries, and are open and closed by the flat faces of the pistons 2 and 5. A gear coupling 20 between the shafts 13 and 17 ensure that the units 1 and 4 rotate relatively to the pistons 2 and 5 in the manner described.

The units 1 and 4 can be encapsulated or shrouded to distinct upper and lower temperature regions around them, each unit presenting a large surface area for efficient heat transfer. The rotation of those units promotes near-uniform temperature distribution.

In addition to maintaining a temperature differential between the units 1 and 4, there can be additional heating and cooling means for the ducts 11 and 12 provided, for example, by adaptation of the encapsulation or shrouding to enclose the ends of the ducts. Any further heating means will be between the regenerators and the unit 1, while any further cooling means will be between the regenerators and the unit 4.

FIG. 6 shows the two rotatable structures isolated, for simplicity. There will of course be a connection to one or the other in order to get work out, in the case of an engine, or to put work in, in the case of a pump. The shafts 13 and 17 can be suitably adapted.

It will be understood that while a simple embodiment with three-sided pistons operating in two-lobed chambers has been described, there could be more elaborate arrangements with n+1 (n>2) sided pistons in n-lobed chambers connected by a corresponding number of ducts with regenerators. The relative speeds of rotation of the chambers to the pistons will be n+1:n.

TABLE 1

| Piston | Chamber | Relative Motor | Compression Chamber | | | Duct | | Compression Chamber | | |
|---|---|---|---|---|---|---|---|---|---|---|
| Rotation | Rotation | Rotation | 3a | 3b | 3c | 11 | 12 | 6a | 6b | 6c |
| 0 | 0 | 0 | — | Expan | Exhaust | → Regen | — | Comp | Comp | Intake |
| 30 | 45 | 15 | Intake | Expan | Exhaust | → Regen | ← Regen | Comp | Exhuast | Intake |
| 60 | 90 | 30 | Expan | Expan | Exhaust | → Regen | — | Comp | — | Intake |
| 90 | 135 | 45 | Expan | Exhaust | Exhaust | → Regen | → Regen | Comp | Intake | Intake |
| 120 | 180 | 60 | Expan | Exhaust | — | — | → Regen | Comp | Intake | Comp |
| 150 | 325 | 75 | Expan | Exhaust | Intake | ← Regen | → Regen | Exhaust | Intake | Comp |
| 180 | 270 | 90 | Expan | Exhaust | Expan | — | → Regen | — | Intake | Comp |
| 210 | 315 | 105 | Exhaust | Exhaust | Expan | → Regen | → Regen | Intake | Intake | Comp |
| 240 | 360 | 120 | Exhaust | — | Expan | → Regen | — | Intake | Comp | Comp |
| 270 | 405 | 135 | Exhaust | Intake | Expan | → Regen | ← Regen | Intake | Comp | Exhaust |
| 300 | 450 | 150 | Exhaust | Expan | Expan | → Regen | — | Intake | Comp | — |

TABLE 1-continued

| Piston | Chamber | Relative Motor | Compression Chamber | | | Duct | | Compression Chamber | | |
|---|---|---|---|---|---|---|---|---|---|---|
| Rotation | Rotation | Rotation | 3a | 3b | 3c | 11 | 12 | 6a | 6b | 6c |
| 330 | 495 | 166 | Exhaust | Expan | Exhaust | → Regen | → Regen | Intake | Comp | Intake |
| 360 | 540 | 180 | — | Expan | Exhaust | — | → Regen | Comp | Comp | Intake |
| 390 | 585 | 195 | Intake | Expan | Exhaust | ← Regen | → Regen | Comp | Exhaust | Intake |
| 420 | 630 | 210 | Expan | Expan | Exhaust | — | → Regen | Comp | — | Intake |
| 450 | 675 | 225 | Expan | Exhaust | Exhaust | → Regen | → Regen | Comp | Intake | Intake |
| 480 | 720 | 240 | Expan | Exhaust | — | → Regen | — | Comp | Intake | Comp |
| 510 | 765 | 255 | Expan | Exhaust | Intake | → Regen | ← Regen | Exhaust | Intake | Comp |
| 540 | 810 | 270 | Expan | Exhaust | Expan | → Regen | — | — | Intake | Comp |
| 570 | 855 | 285 | Exhaust | Exhaust | Expan | → Regen | → Regen | Intake | Intake | Comp |
| 600 | 900 | 300 | Exhaust | — | Expan | — | → Regen | Intake | Comp | Comp |
| 630 | 945 | 315 | Exhaust | Intake | Expan | ← Regen | → Regen | Intake | Comp | Exhaust |
| 660 | 990 | 330 | Exhaust | Expan | Expan | — | → Regen | Intake | Comp | — |
| 690 | 1035 | 345 | Exhaust | Expan | Exhaust | → Regen | → Regen | Intake | Comp | Intake |
| 720 | 1080 | 360 | — | Expan | Exhaust | → Regen | — | Comp | Comp | Intake |

Rotation angles are in degrees.
—: stagnated fluid or vapour flow.
Expan: an Expansion process.
Comp: a compression process.
→
Regen: Regenerative transfer from expander to compressor.
←
Regen: Regenerative transfer from compressor to expander.

TABLE 2

| | | | | | | | | | | | | |
|---|---|---|---|---|---|---|---|---|---|---|---|---|
| 0/0 | 30/45 | 60/90 | 90/135 | 120/180 | 150/225 | 180/270 | 210/315 | 240/360 | 270/405 | 302/450 | 330/495 | 300/540 |
| ←Comp 6a→ | | | ←Regen 6a + Duct 11 + 3c→ | | | ←Expan 3c→ | | | | ←Regen 3c + Duct 12 + 3c→ | | |
| 360/450 | 390/585 | 420/630 | 450/675 | 480/720 | 510/765 | 540/810 | 570/855 | 600/900 | 830/445 | 660/470 | 690/635 | 720/1050 |
| ←Regen 3c + Duct 12 + 6c→ | | | | | ←Comp 6c→ | | | ←Regen 6c + Duct 11 + 3b→ | | | ←Expan 3b→ | |
| 720/1080 | 750/1125 | 750/1170 | 810/1215 | 640/1260 | 870/1305 | 400/1350 | 430/1395 | 460/1440 | 990/1985 | 1020/1530 | 1650/1575 | 1680/1620 |
| ←Expan 3b→ | | | ←Regen 3b + Duct 15 + 6b→ | | | | | | ←Comp 6b→ | | | |
| 1080/1620 | 1110/1365 | 1140/1710 | 1170/1755 | 1250/1800 | 1230/1845 | 1260/1890 | 1240/1435 | 1370/1950 | 1350/2025 | 1350/2070 | 1440/2115 | 1440/2160 |
| ←Regen 6b + Duct 11 + 3b→ | | | ←Expan 3a→ | | | | | ←Regen 3a + Duct 12 + 6a→ | | | | |

Numbers denote the piston rotation followed by the corresponding chamber rotation in degrees.
Comp: Compression process.
Regen: Regenerative transfer process.
Expan: Expansion process.
3a, 3b, 3c: expansion chamber identification.
6a, 6b, 6c: compression chamber identification.

What is claimed is:

1. A fluid or vapour rotary piston machine including two variable-volume units, each unit having a rotary multi-lobed epitrochoidal chamber and a multi-sided rotary piston therein forming a plurality of individual sub-chambers by its co-operation with the periphery of the associated chamber, the number (n+1) of piston sides being greater by one than the number (n) of epitrochoid arcs, wherein the two chambers are constrained to rotate at a first common speed about a first effective common axis while the two pistons are constrained to rotate at a second common speed about a second effective common axis, the ratio of first to second common speeds being n+1:n, wherein each chamber has a plurality (n) of dual-function ports enabling connection between the chambers via ducts, and wherein said ducts each contain a regenerator, enabling one variable-volume unit to perform intake, expansion and exhaust, while the other unit performs intake, compression and exhaust, as a result of the relative rotation and port positions.

2. A rotary piston machine as claimed in claim 1, wherein heating means are provided for the variable-volume unit which performs the expansion processes.

3. A rotary piston machine as claimed in claim 2, wherein further heating means are provided between each said regenerator and the variable-volume unit which performs the expansion processes.

4. A rotary piston machine as claimed in claim 1, wherein cooling means are provided for the variable-volume unit which performs the compression processes.

5. A rotary piston machine as claimed in claim 4, wherein further cooling means are provided between each said regenerator and the variable-volume unit which performs the compression processes.

6. A rotary piston machine as claimed in claim 1, wherein n=2.

7. A rotary piston machine comprising:

a fixed mounting;

a chamber unit rotatably attached to the fixed mounting, the chamber unit defining first and second chambers;

first and second pistons disposed in the first and second chambers, respectively, the first and second pistons being carried by a piston shaft rotatably attached to the fixed mounting;

a coupling interconnecting the chamber unit and the piston shaft so that as each of the chamber unit and the piston shaft rotates with respect to the fixed mounting, a rotational ratio of the chamber unit with respect to the piston shaft is held constant.

8. The rotary piston machine of claim 7, wherein the rotational ratio of the chamber unit with respect to the piston shaft is n+1:n.

9. The rotary piston machine of claim 8, wherein each of the chambers is a multi-lobed epitrochoidal chamber, each of the pistons is a multi-sided rotary piston, each of the chambers having n lobes, and each of the pistons having n+1 sides.

10. The rotary piston machine of claim 9, further comprising n dual-function ports arranged on each of the chambers enabling connection between the first and second chambers via ducts.

11. The rotary piston machine of claim 10, wherein each of the ducts comprises a regenerator, wherein the rotary piston machine is arranged so that one of the chambers performs intake, expansion, and exhaust as an expansion unit, while another of the chambers performs intake, compression, and exhaust as a compression unit.

12. An engine comprising:

the rotary piston machine of claim 11;

a high-grade heat transfer element arranged to perform high-grade heat transfer to at least one of a fluid flowing into, flowing from, or contained within the expansion unit; and a low-grade heat transfer element arranged to perform low-grade heat transfer from at least one of a fluid flowing into, flowing from, or contained within the compression unit;

wherein the engine produces mechanical work output.

13. A refrigeration device comprising:

the rotary piston machine of claim 11;

a source of mechanical work arranged to induce rotation of the chamber unit and the piston shaft of the rotary piston machine;

a high-grade heat transfer element arranged to perform high-grade heat transfer from at least one of a fluid flowing into, flowing from, or contained within the compression unit; and a low-grade heat transfer element arranged to perform low-grade heat transfer to at least one of a fluid flowing into, flowing from, or contained within the expansion unit.

14. A heat pump comprising:

the rotary piston machine of claim 11;

a source of mechanical work arranged to induce rotation of the chamber unit and the piston shaft of the rotary piston machine;

a high-grade heat transfer element arranged to perform high-grade heat transfer from at least one of a fluid flowing into, flowing from, or contained within the compression unit; and a low-grade heat transfer element arranged to perform low-grade heat transfer to at least one of a fluid flowing into, flowing from, or contained within the expansion unit.

* * * * *